US006064025A

United States Patent [19]

Thuries

[11] Patent Number: 6,064,025

[45] Date of Patent: May 16, 2000

[54] CONTROL MEANS FOR ELECTRICAL EQUIPMENT, E.G. FOR A HIGH-VOLTAGE CIRCUIT-BREAKER

[75] Inventor: Edmond Thuries, Meyzieu, France

[73] Assignee: GEC Alsthom T & D SA, Paris, France

[21] Appl. No.: 09/159,587

[22] Filed: Sep. 24, 1998

[30] Foreign Application Priority Data

Sep. 25, 1997 [FR] France ..... 97 11936

[51] Int. Cl.[7] ..... H01H 33/70

[52] U.S. Cl. ..... 218/78; 218/14; 218/51; 218/60

[58] Field of Search ..... 218/13–14, 51–52, 218/78, 88, 91–2, 93, 120, 140, 59–66, 43, 45, 57

[56] References Cited

U.S. PATENT DOCUMENTS

| | | | |
|---|---|---|---|
| 4,118,613 | 10/1978 | Barkan et al. | 200/82 |
| 4,166,937 | 9/1979 | Imam et al. | 200/82 |
| 5,296,662 | 3/1994 | Engdahl et al. | 218/43 |

FOREIGN PATENT DOCUMENTS

| | | |
|---|---|---|
| 1 003 321 | 2/1957 | Germany . |
| 1 036 982 | 8/1958 | Germany . |
| 770100 | 3/1957 | United Kingdom . |

*Primary Examiner*—Lincoln Donovan
*Attorney, Agent, or Firm*—Sughrue, Mion, Zinn, Macpeak & Seas, PLLC

[57] ABSTRACT

A controller for electrical equipment, in particular for a high-voltage circuit-breaker, the equipment being housed in a casing filled with a dielectric gas under pressure. An interrupting chamber within the casing extinguishes arcs produced by the main circuit-breaker contacts. The equipment employs a contact connecting rod designed to be moved in translation by said controller. The controller employs an operating piston mounted to slide in a cylindrical element fixed to the casing and connected to a communication duct for communicating with the inside of the casing via an actuating valve in the engagement position. The controller further includes a suction enclosure connected to said cylindrical element and communicating with the inside thereof via a communication duct when the actuating valve is in the disengagement position. A suction piston is mounted to slide in the enclosure. In addition, a reciprocating drive mechanism drives the suction piston in a reciprocating motion.

12 Claims, 10 Drawing Sheets

ENGAGED

ENGAGED

DISENGAGED

CONTROL MEANS FOR ELECTRICAL EQUIPMENT, E.G. FOR A HIGH-VOLTAGE CIRCUIT-BREAKER

FIELD OF THE INVENTION

The present invention relates to control means for electrical equipment, in particular for a high-voltage circuit-breaker.

It relates more precisely to control means for electrical equipment, in particular for a high-voltage circuit-breaker, the equipment being housed in a casing filled with a dielectric gas under pressure, forming an interrupting chamber, and provided with a part designed to be moved in translation by said control means, which means comprise an operating piston mounted to slide in a cylindrical element fixed to the end of the casing and connected, at its end facing away from the equipment in the vicinity of the active face of the piston, to a communication duct for communicating with the inside of the casing via a valve in a first or "engagement" position, which valve can take up a second or "disengagement" position in which the gas pressing against the active face of the piston is removed from said cylindrical element.

BACKGROUND OF THE INVENTION

Such control means are described in Patent Document DE-B-1 003 321.

As described in that prior document, the communication duct is provided with an orifice that is open to atmospheric air, and with a valve having two seats. In the engagement position, the valve closes the duct enabling the gas to pass from the interrupting chamber to the active face of the piston, and, in the disengagement position, it closes that portion of the duct which communicates with the interrupting chamber so as to open the orifice to that portion of the duct which communicates with the cylindrical element, thereby removing the gas to the outside, reducing the pressure on the active face of the piston, and separating the contacts of the circuit-breaker.

Although they offer the advantage of using the pressurized dielectric gas in the interrupting chamber as the actuating gas of the control means, such control means do not make it possible to guarantee a fast opening/closing/opening cycle, because of the time required to remove the pressurized gas to the atmosphere and to bring the portions that have been connected to the atmosphere back under pressure after opening.

OBJECTS AND SUMMARY OF THE INVENTION

The invention proposes to improve such control means so as to enable the re-engagement, opening, and closing operations to be fast.

To this end, according to the invention, the control means further comprise:

- a suction enclosure connected to said cylindrical element and communicating with the inside thereof via a communication duct when said valve is in the disengagement position, and provided with at least one check valve for removing the gas on its face facing away from the equipment;
- a suction piston mounted to slide in said enclosure, whose active face faces towards the operating piston and is provided with at least one check valve allowing the gas to pass only from the active face to behind the piston; and
- a reciprocating drive mechanism for driving said suction piston in reciprocating motion.

In the preferred embodiment, the rod, the operating piston, and the suction piston are in alignment, their displacements thus being linear along the axis of the equipment.

In order to generate the suction in the suction enclosure after the pressure has increased as a result of circuit-breaker operation or as a result of internal leakage, the enclosure is advantageously provided with a pressure-sensitive switch causing the drive mechanism to operate when the pressure in the enclosure is greater than a reference value.

Advantageously, the actuating valve is a slide valve having two slides and two seats and actuated by two pilot valves, namely a pressure pilot valve and a suction pilot valve.

Preferably, said communication duct is provided in the wall of the cylindrical element.

Advantageously, said check valve for removing gas from the enclosure is disposed at the mouth of an exhaust duct for removing the gas to the casing of the interrupting chamber.

Preferably, said exhaust duct is formed in the wall of the enclosure.

In a variant embodiment of the operating piston, continuous suction is applied to the annular section of the operating piston.

In which case, to reduce gas consumption to as little as possible, the operating piston is made up of two portions, namely a small-section and full-stroke portion mounted to slide in the other, large-section and short-stroke portion.

Advantageously, a spring may urge the operating piston into the engagement position.

Conventionally, said drive mechanism is constituted by a motor whose shaft is connected to the suction piston by means of a thread.

A spring may act on the suction piston, so as to reduce the load on the motor.

BRIEF DESCRIPTIONS OF THE DRAWINGS

The invention is described below in more detail with reference to the figures which merely show a preferred embodiment of the invention, and in which.

MORE DETAILED DESCRIPTION

Figure 1A:
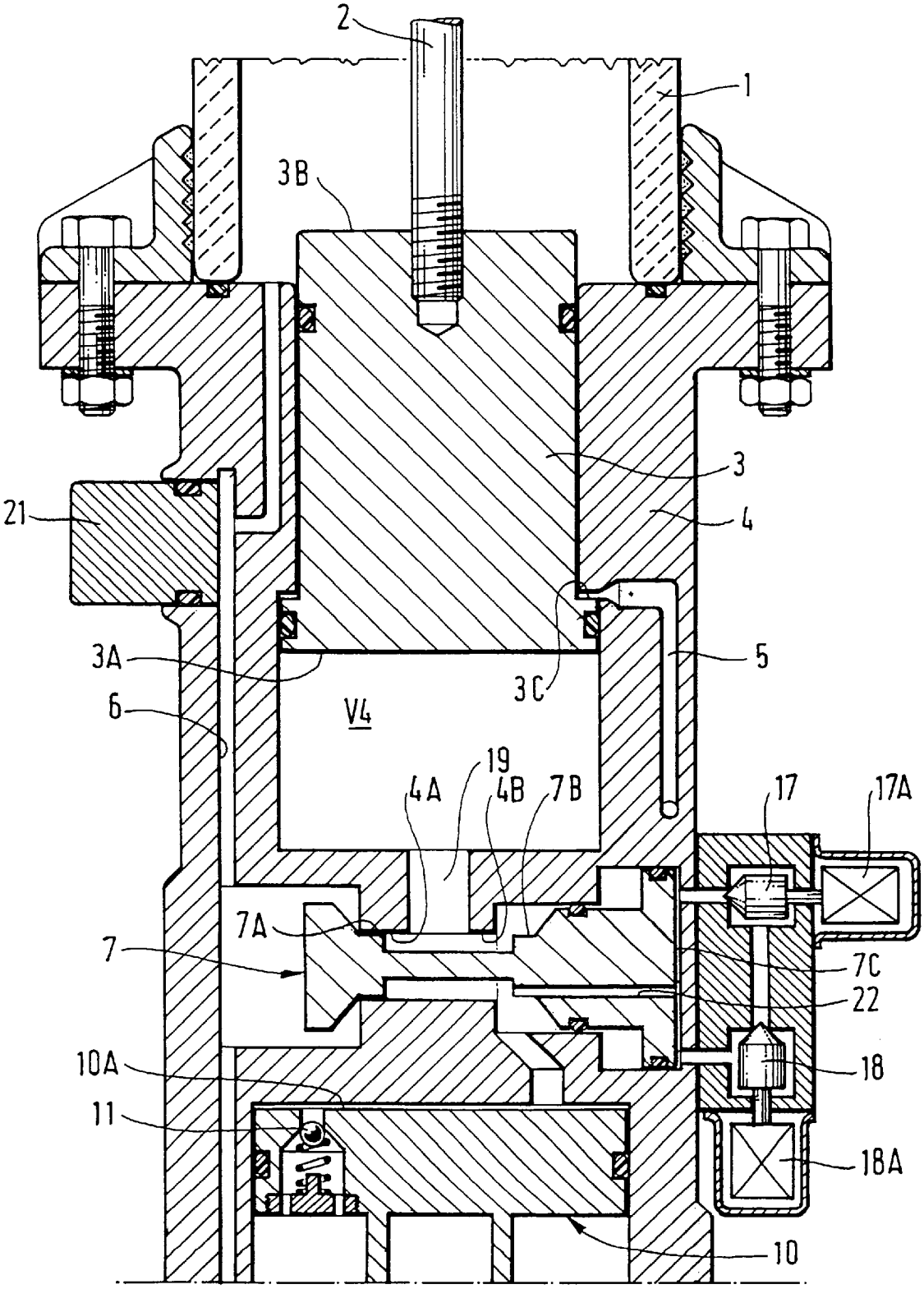
FIGS. 1A and 1B are fragmentary views in longitudinal section showing control means of the invention in the start-of-disengagement (or start-of-opening) position.

A high-voltage circuit-breaker (not shown in the Figures) is housed inside a casing 1 made of an insulating material in this example but optionally being made of metal, filled with a dielectric gas under pressure, and forming an interrupting chamber. The moving contacts of the circuit-breaker are associated with a rod 2 designed to be moved in translation by the control means. At its end, the rod 2 is fixed to an operating piston 3 mounted to slide in a cylindrical element 4 fixed to the end of the casing 1 and provided with an outlet orifice 19.

Figure 1B:
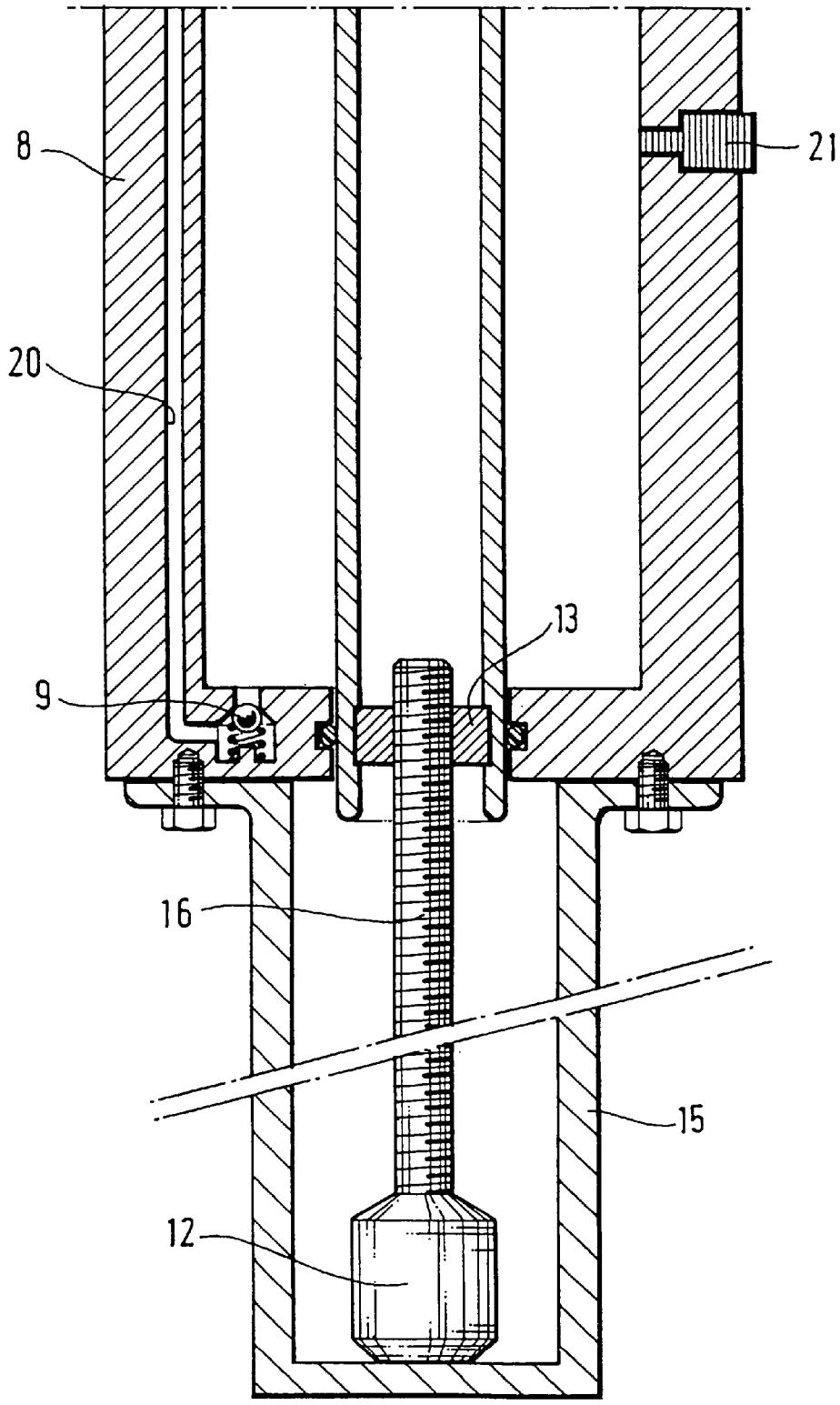

In the embodiment shown in the FIGS. 1A and 1B, piston 3 is a differential piston, the area of its active face 3A being greater than the area of its opposite face 3B to which the rod 2 is fixed, e.g. by screwing.

Preferably, to increase the differential pressure effect on the piston 3, suction is continuously applied to the annular section 3C of the operating piston via the channel 5, the piston 3 being provided with annular sealing gaskets in the vicinities of its end faces 3A and 3B.

Figure 3:
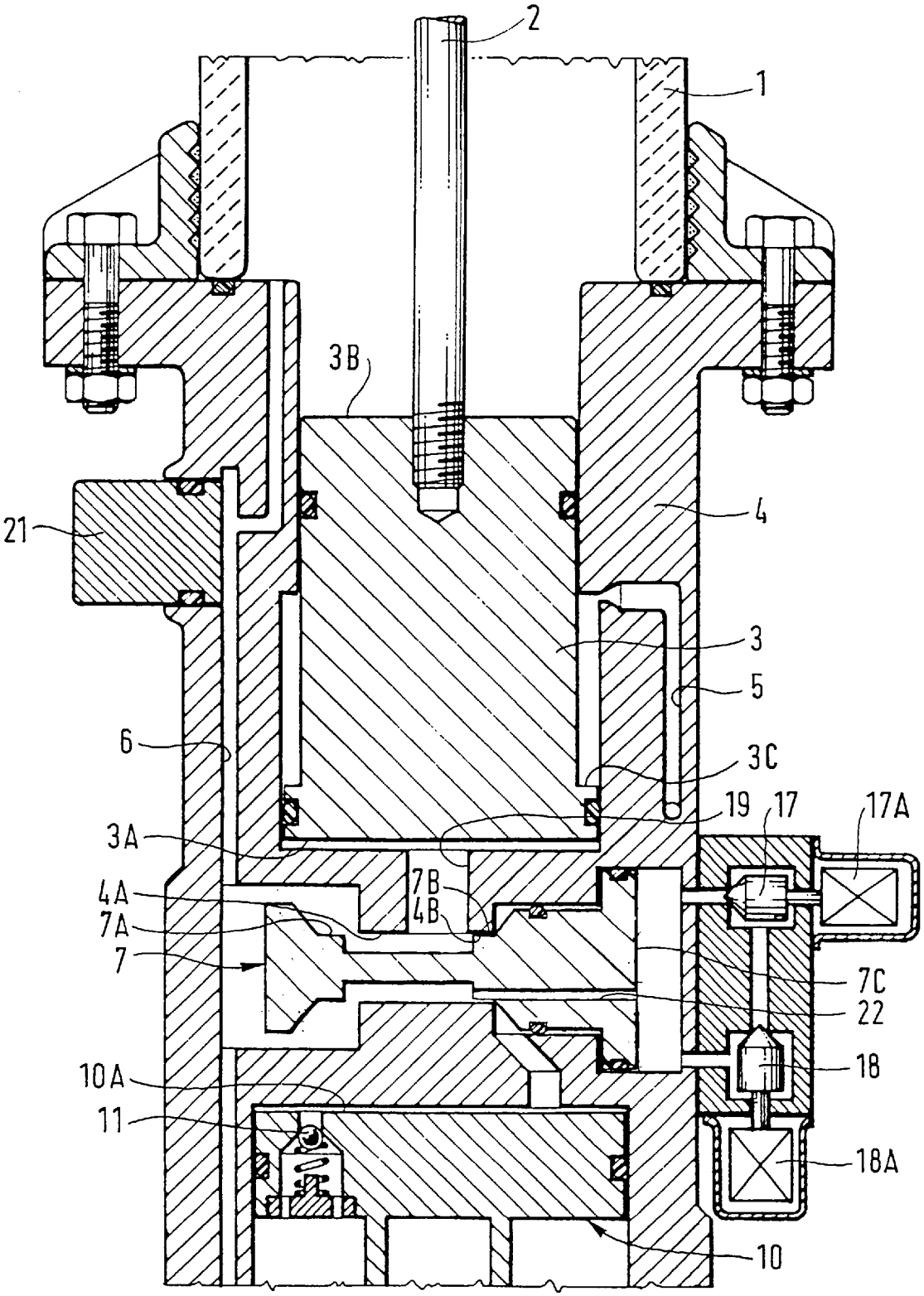
FIG. 3 is a fragmentary view in longitudinal section, in the start-of-engagement (or start-of-closure) position.

At its end closer to the active face 3A of the piston 3, the inside of the cylindrical element 4 is connected to a communication duct 6 that communicates with the inside of the casing 1 via an actuating valve 7 when said valve is in the engagement position, as shown in FIG. 3. Advantageously, the communication duct 6 is provided in the wall of the cylindrical element 4.

The valve 7 can take up a second position, namely a disengagement position, as shown in FIGS. 1A and 1B, in which position the gas pressing against the active face 3A of the operating piston 3 is removed from the cylindrical element 4 to a suction enclosure 8.

The actuating valve 7 is a slide valve having two slides 7A, 7B and two sealing seats 4A, 4B, and it is actuated by two pilot valves 17, 18 driven by electromagnets 17A, 18A enclosed in leaktight housings.

Pressure is fed to the pilot valve 17 and, once actuated, it pushes the wall 70 of the actuating valve 7, thereby pressing the slide 7B against the seat 4B formed by a shoulder on the outlet orifice 19 of the cylindrical element 4, and opening the passage from the enclosure 4 to the inside of the casing 1 of the interrupting chamber and closing the passage from the cylindrical element 4 to the enclosure 8, as shown in FIG. 3.

Suction is fed to the pilot valve 18 and, once actuated, it pulls the wall 7C of the actuating valve 7, thereby pressing the slide 7A against the seat 4A formed by the shoulder on the outlet orifice 19 of the cylindrical element 4, and closing the passage from the enclosure 4 to the inside of the casing 1 of the interrupting chamber and opening the passage from the cylindrical element 4 to the enclosure 8, as shown in FIG. 1.

The slides 7A, 7B prevent the higher pressure gas from communicating with the lower pressure gas while the valve 7 is moving.

A self-feed orifice 22 of very small diameter enables the actuating valve 7 to be maintained in the position which it has been instructed to take up by the pilot valves 17, 18, after they have closed.

The suction enclosure 8 is connected to the cylindrical element 4 which is advantageously integral therewith, and which, on its face facing away from the equipment, is provided with at least one check valve 9 for removing the gas. A suction piston 10 is mounted to slide in the enclosure 8, the active face 10A of the suction piston facing towards the operating piston 3 and being provided with at least one check valve 11 allowing the gas to pass through only from the active face 10A to behind the piston 10. The check valve 9 for removing the gas from the enclosure is disposed at the mouth of an exhaust duct 20 for removing the gas to the inside of the casing 1 of the interrupting chamber. Advantageously, the exhaust duct 20 is provided in the wall of the enclosure 8.

Figure 9:
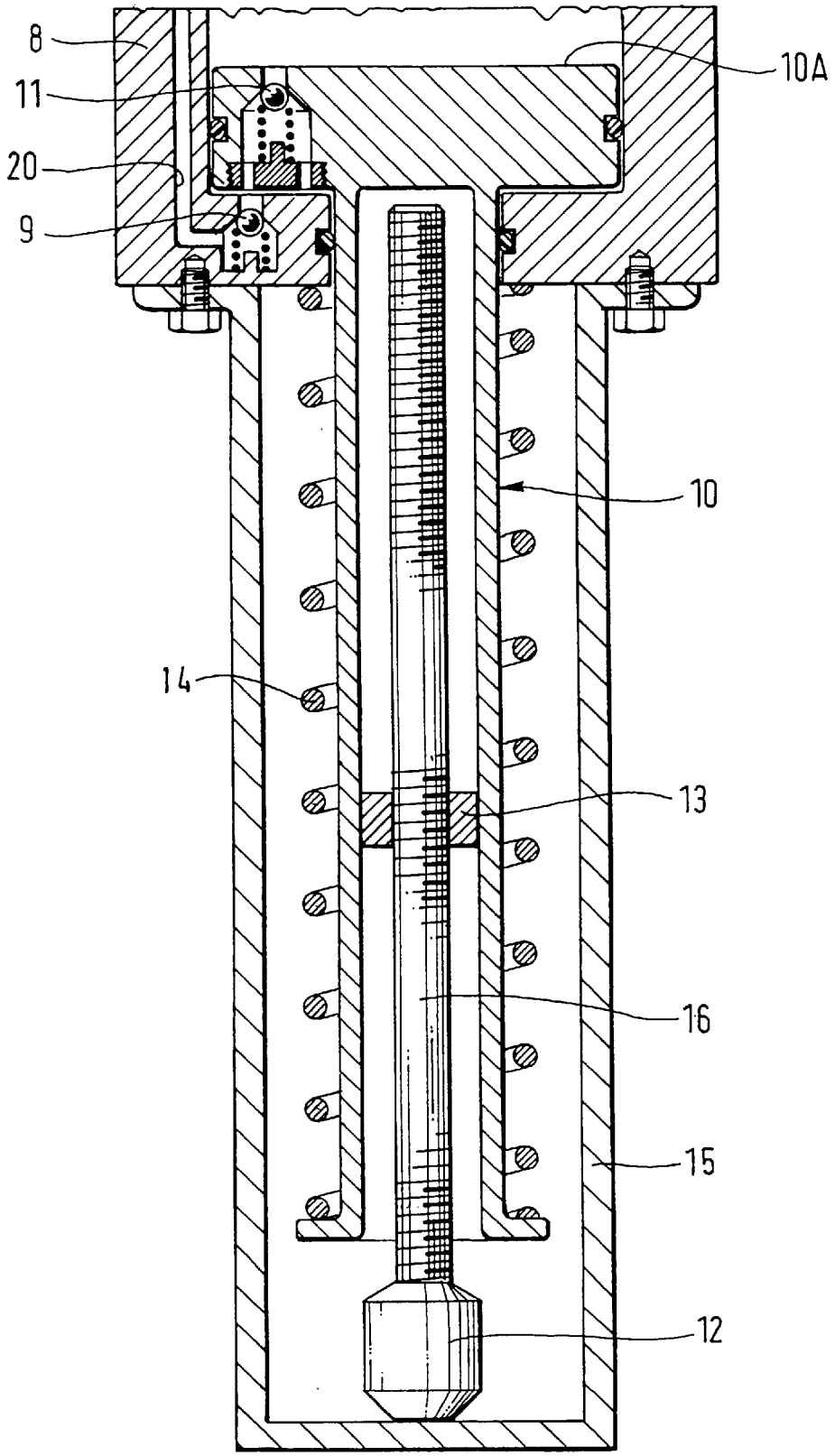
FIG. 9 is a fragmentary view in longitudinal section showing a variant embodiment of the drive mechanism.

A reciprocating drive mechanism for driving the suction piston 10 back and forth is constituted by a motor 12 whose shaft 16 is connected to the suction piston 10 by means of a thread preferably formed on the shaft and co-operating with a nut 13 secured to the piston 10. In a variant embodiment shown in FIG. 9, a spring 14 acts on the suction piston 10. The drive mechanism is received in a case 15 fixed to the enclosure 8.

The circuit-breaker with its rod 2, the operating piston 3, the suction piston 10, and the drive mechanism are in alignment.

The enclosure is equipped with a pressure-sensitive switch 21 causing the drive mechanism to operate when the pressure in the enclosure is greater than a reference value. Thus, if the suction decreases in the enclosure 8 as a result of operating or of leaks, the suction piston 10 is moved in reciprocating motion by the drive mechanism so as to re-establish the suction.

The control means operate as follows.

Figure 2:
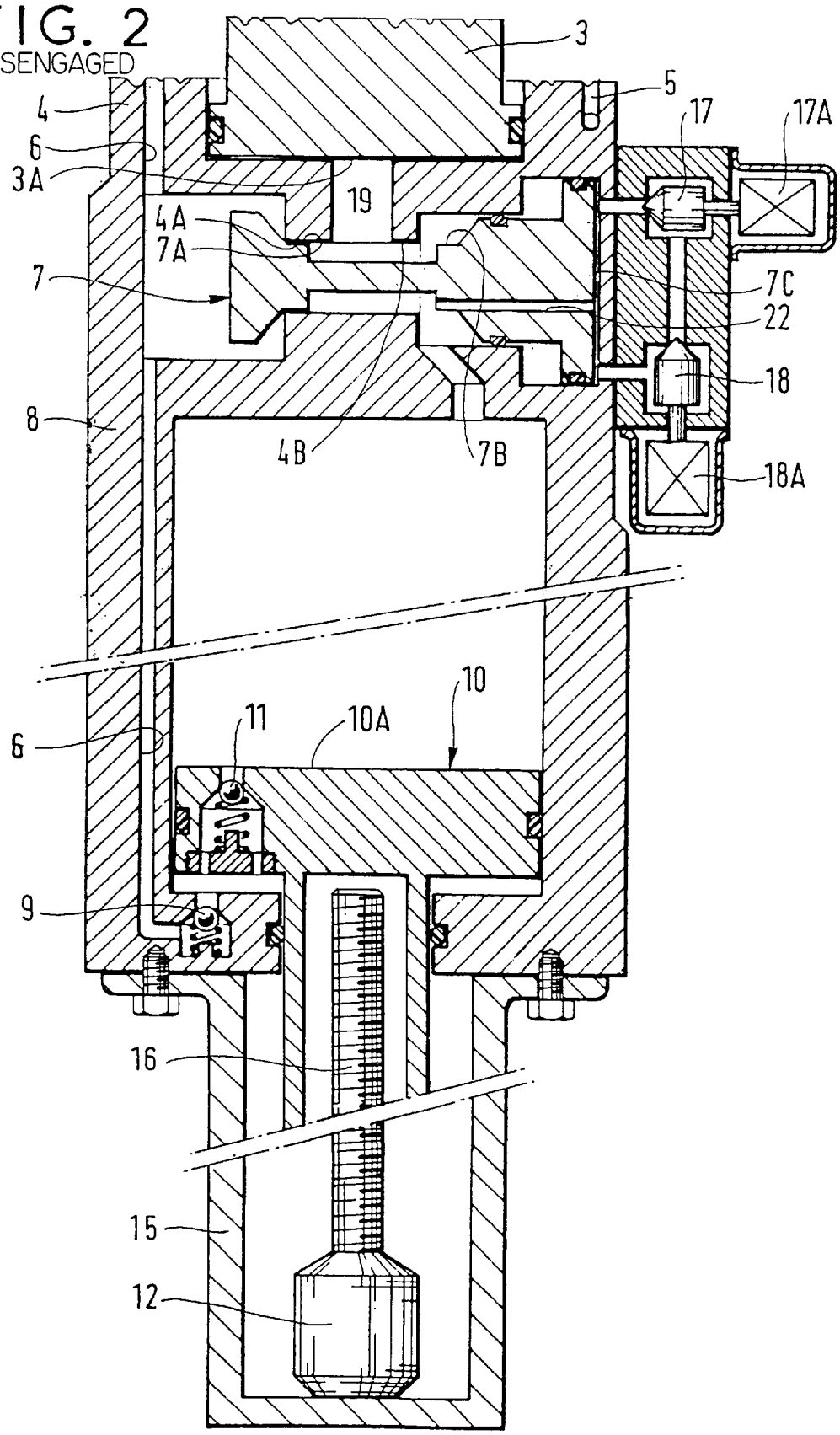
FIG. 2 is a fragmentary view in longitudinal section, in the disengaged position.

At the start of disengagement, as shown in FIGS. 1A and 1B, the actuating valve 7 has been moved into the pulled-out position by means of the suction pilot valve 18, thereby allowing gas to pass from the cylindrical element 4 to the enclosure 8. The suction piston 10 is moved into its pulled-out position (i.e. downwards as seen in the figure), and the gas contained in the cylindrical element 4 is removed to the enclosure 8. The operating piston 3 is moved (downwards as seen in the figure), and it causes the contacts of the circuit-breaker to open so as to come into the disengaged position shown in FIG. 2.

To re-engage the circuit-breaker, the actuating valve 7 is moved into the pushed-in position by means of the suction pilot valve 17, thereby enabling gas to pass to the cylindrical element 4 from the inside of the casing 1 of the circuit-breaker as shown in FIG. 3. The cylindrical element 4 is filled with dielectric gas under pressure, the operating piston 3 is moved (pushed upwards as seen in the figure), thereby closing the contacts of the circuit-breaker so as to come into the engagement position shown in FIGS. 1A and 1B.

Because of the varying-section shape of the operating piston, or advantageously, because of the suction continuously applied to its annular face 3C, when the dielectric gas pressure is exerted on its active face 3A, said face 3A is subjected to a pressure greater than the pressure exerted on its opposite face 3B in the interrupting chamber.

The rest position of the suction piston 10 is the pulled-out position (the low position as seen is the figures), but, by means of a sufficient number of check valves 11, suction is always maintained above the piston 10, in communication with the actuating valve 7, thereby guaranteeing that operation is fast.

During disengagement, the gas contained in the cylindrical element 4 of volume V4 is removed to the suction enclosure 8, and it causes the pressure in the enclosure 8 to increase. This is detrimental to a fast re-engagement cycle. It is therefore desirable for the increase in pressure to be as small as possible and thus for the volume V4 to be as small as possible.

To achieve this, variant embodiments of the operating piston 3 are proposed.

Figure 4:
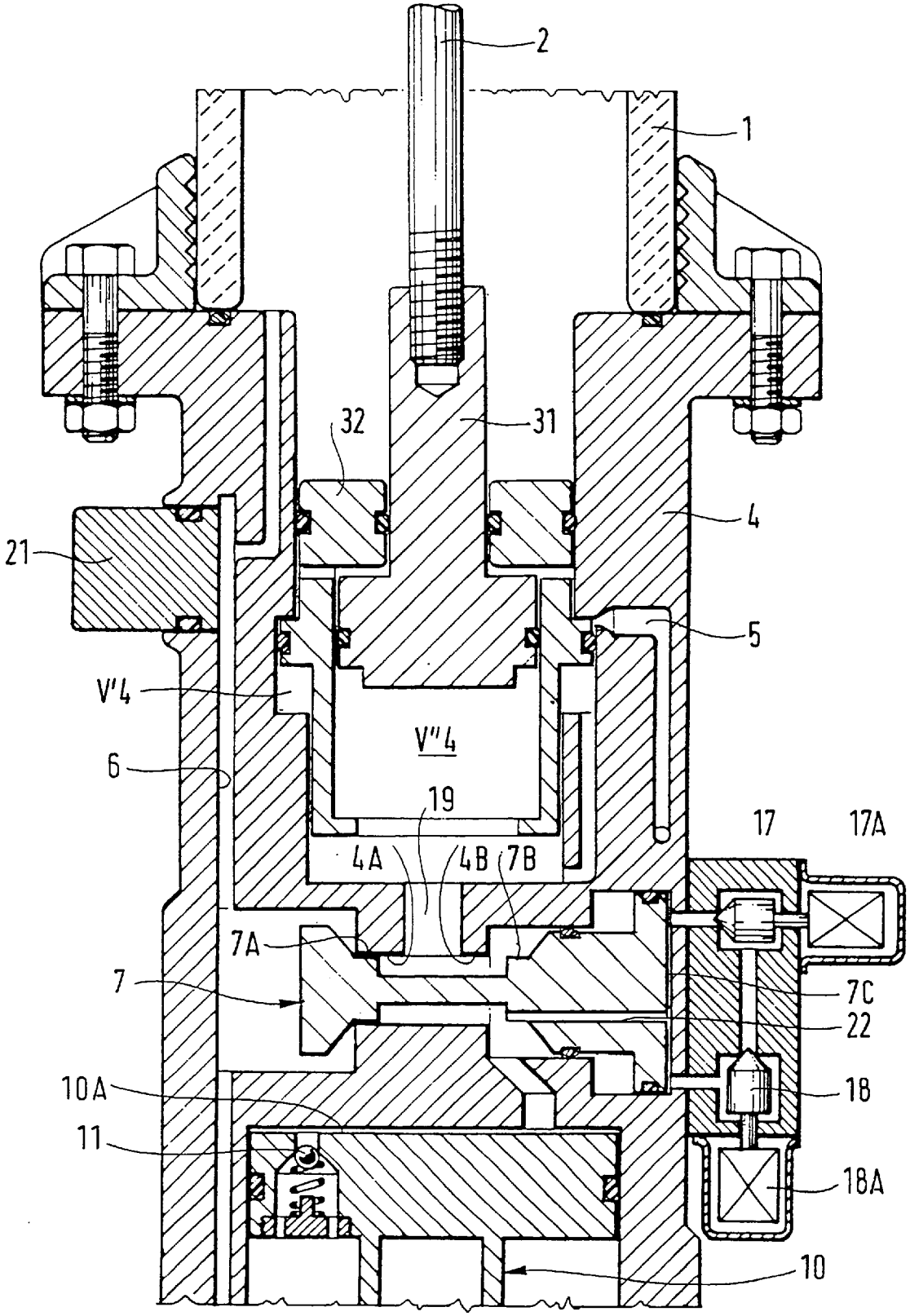
FIG. 4 is a fragmentary view in longitudinal section showing a first variant embodiment in the start-of-disengagement position.
Figure 5:
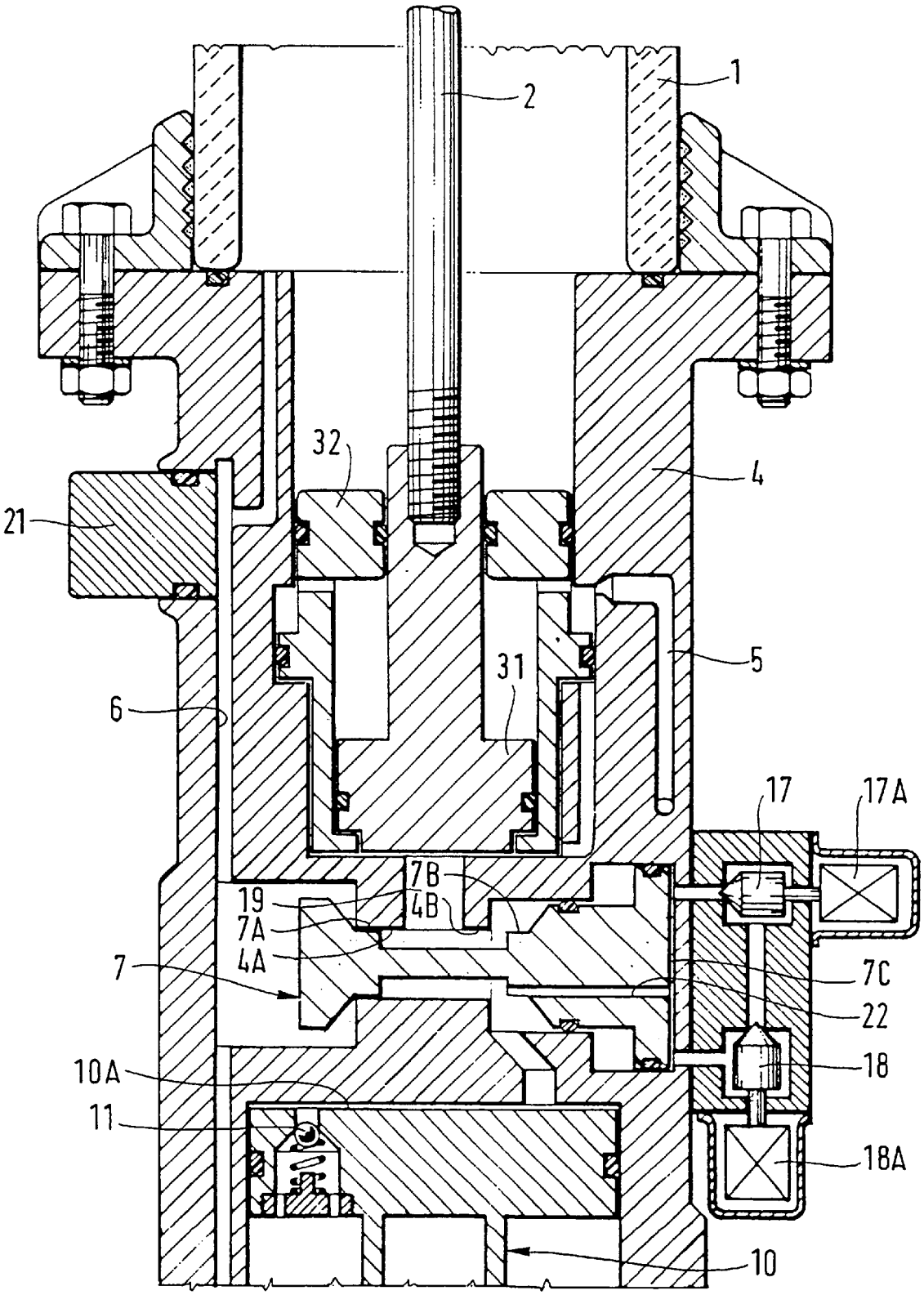
FIG. 5 is a fragmentary view in longitudinal section showing the first variant embodiment in the end-of-disengagement position.

In a first variant shown in FIG. 4 in the start-of-disengagement position, and in FIG. 5 in the end-of-disengagement position, the operating piston 3 is made up of two portions 31 and 32, namely a small-section full-stroke portion 31 sliding in the other, large-section short-stroke portion.

More precisely, the portion 32 is constituted by a cylindrical sleeve mounted to slide in the cylindrical element 4 over a short stroke implemented by means of an arrangement comprising an annular shoulder on the portion 32 and an annular recess for receiving the shoulder, which recess is provided in the cylindrical element 4 and delimits a volume V4' in communication with the inside of the cylindrical element 4 via orifices.

The portion 31 is constituted by a conventional piston mounted to slide in said sleeve 32 and delimiting a volume V4" in the cylindrical element 4 in the engaged position.

Suction is applied to the annular faces of the two portions 31 and 32 via the duct 5.

The volume of gas is then equal to V4'+V4", and is at a minimum.

Figure 6:
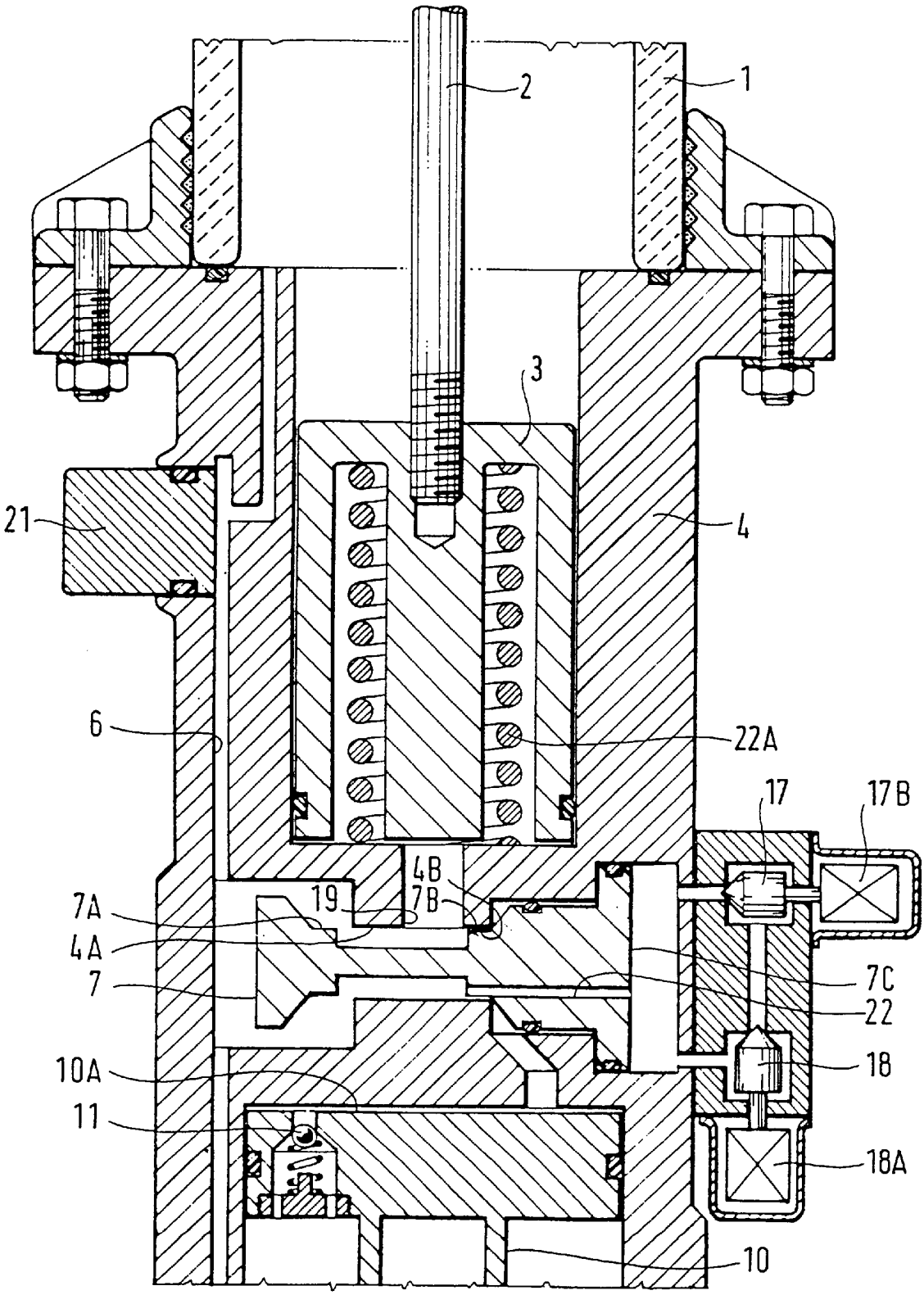
FIG. 6 is a fragmentary view in longitudinal section showing a second variant embodiment in the start-of-engagement position.

In a second variant shown in FIG. 6 in the start-of-disengagement position, a spring 22 urges the operating piston 3 into the engagement position. It is then no longer necessary to provide suction on the annular face of the piston 3 as described above.

Figure 7:
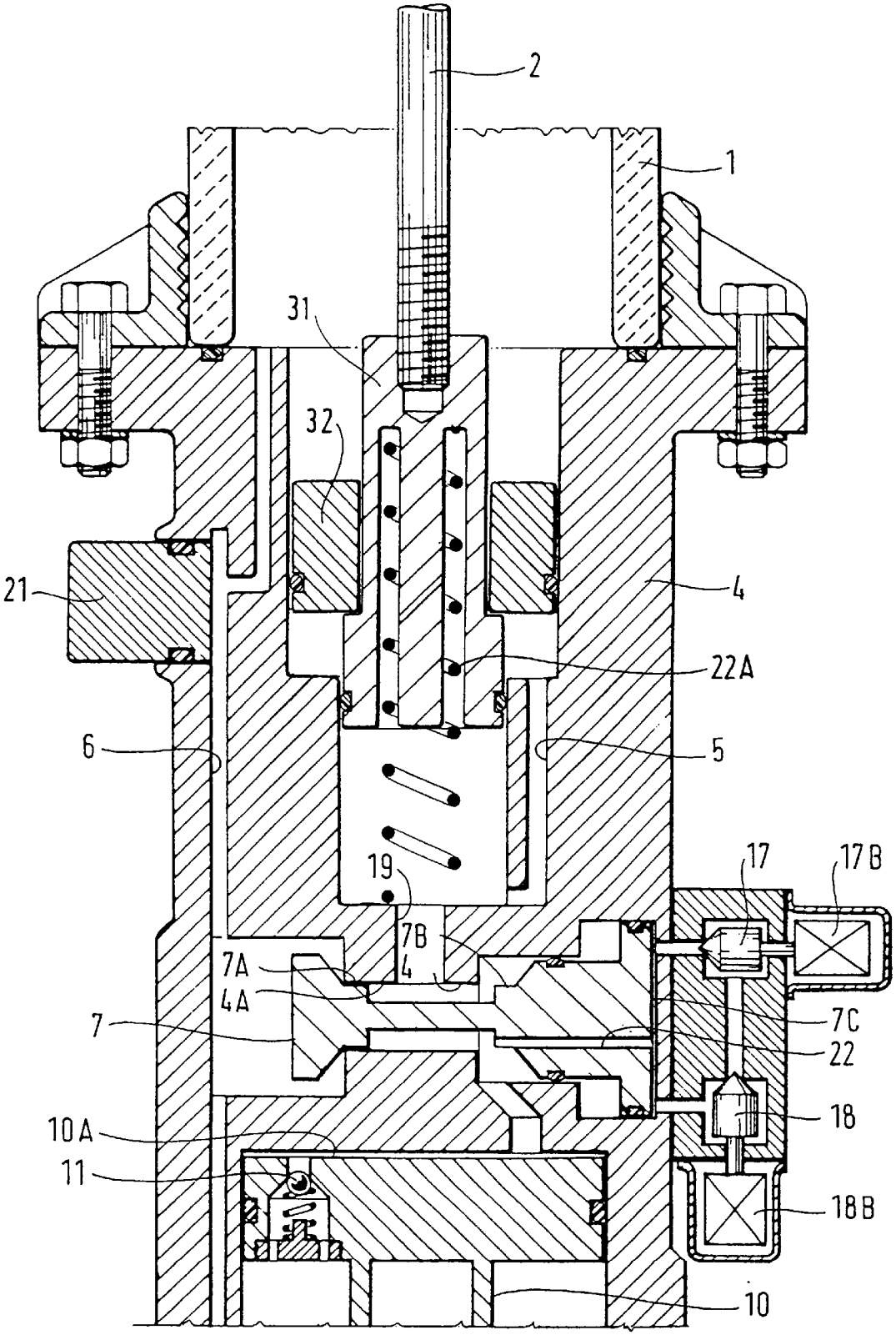
FIG. 7 is a fragmentary view in longitudinal section showing a third variant embodiment in the start-of-disengagement position.
Figure 8:
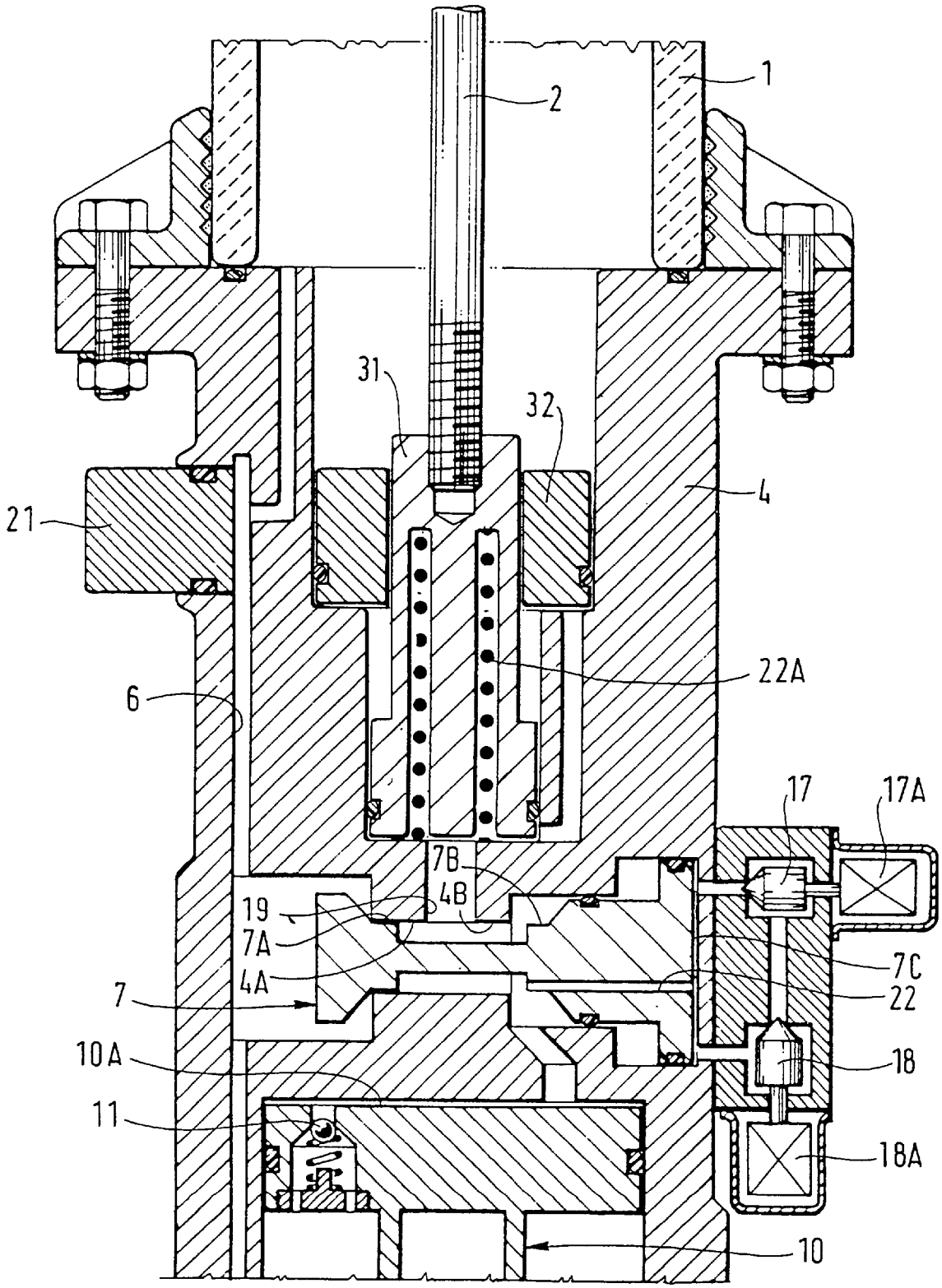
FIG. 8 is a fragmentary view in longitudinal section showing the third variant embodiment in the end-of-disengagement position.

In a third variant shown in FIG. 7 in the start-of-engagement position, and in FIG. 8 in the end-of-disengagement position, the operating piston 3 is made up of two portions 31, 32, namely a small-section and full-stroke portion 31 mounted to slide in the other, large-section and short-stroke portion, and it is urged by a spring 22 into the engaged position. The third variant combines the characteristics of the first variant and of the second variant.

I claim:

1. A controller for electrical equipment, in particular for a high-voltage circuit-breaker, the equipment being housed in a casing filled with a dielectric gas under pressure, said casing having an interrupting chamber for extinguishing an arc, and provided with a contact connecting rod designed to be moved in translation by said controller, which comprises an operating piston mounted to slide in a cylindrical element fixed to the casing and in contact, at its end facing away from the equipment along a periphery of an active face of the piston, to a communication duct for communicating with the inside of the casing via an actuating valve in a first or "engagement" position, which valve can take up a second or "disengagement" position in which the dielectric gas pressing against the active face of the piston is removed from said cylindrical element, said controller further comprising:

a suction enclosure connected to said cylindrical element and communicating with an internal space of said cylindrical element via a communication duct when said valve is in the disengagement position, and provided with at least one check valve for removing the gas on its face facing away from the equipment;

a suction piston mounted to slide in said enclosure, whose active face faces towards the operating piston and is provided with at least one check valve allowing the gas to pass only from the active face to behind the piston; and a reciprocating drive mechanism for driving said suction piston in reciprocating motion.

2. A controller according to claim 1, wherein the rod, the operating piston, and the suction piston are in alignment.

3. A controller according to claim 1, wherein the enclosure is provided with a pressure-sensitive switch causing the drive mechanism to operate when the pressure in the enclosure is greater than a reference value.

4. A controller according to claim 1, wherein the actuating valve is a slide valve having two slides and two seats and actuated by two pilot valves, namely a pressure pilot valve and a suction pilot valve.

5. A controller according to claim 1, wherein said communication duct is provided in the wall of the cylindrical element.

6. A controller according to claim 1, wherein said check valve for removing dielectric gas from the enclosure is disposed at the mouth of an exhaust duct for removing the dielectric gas to the inside of the casing of the interrupting chamber.

7. A controller according to claim 1, wherein said exhaust duct is formed in the wall of the enclosure.

8. A controller according to claim 1, wherein continuous suction is applied to the annular section of the operating piston.

9. A controller according to claim 1, wherein the operating piston is made up of two portions, namely a small-section and full-stroke portion mounted to slide in the other, large-section and short-stroke portion.

10. A controller according to claim 1, wherein a spring urges the operating piston into the engagement position.

11. A controller according to claim 1, wherein said drive mechanism is constituted by a motor whose shaft is connected to the suction piston by means of a thread.

12. A controller according to claim 11, wherein a spring acts on the suction piston.

* * * * *